United States Patent [19]

Colliton

[11] 4,185,231

[45] Jan. 22, 1980

[54] HIGH EFFICIENCY BALLAST SYSTEM FOR GASEOUS DISCHARGE LAMPS

[75] Inventor: Walter A. Colliton, Madisonville, Ky.

[73] Assignee: General Electric Company, Schenectady, N.Y.

[21] Appl. No.: 902,459

[22] Filed: May 2, 1978

[51] Int. Cl.[2] ..... H05B 41/16; H05B 41/232

[52] U.S. Cl. ..... 315/189; 315/97; 315/188; 315/232; 315/245; 315/254; 315/324

[58] Field of Search ..... 315/97, 185 R, 187, 315/188, 189, 228, 245, 250, 254, 312, 324, 232

[56] References Cited

U.S. PATENT DOCUMENTS

| | | | |
|---|---|---|---|
| 2,965,799 | 12/1960 | Brooks et al. | 315/97 |
| 2,965,808 | 12/1960 | Lovinger | 315/326 |
| 3,225,255 | 12/1965 | Hume | 315/232 |

*Primary Examiner*—Eugene R. LaRoche
*Attorney, Agent, or Firm*—Sidney Greenberg

[57] ABSTRACT

Electrical lamp ballast system for starting and operating fluorescent lamps with improved efficiency and safety. System includes high leakage reactance autotransformer having primary and secondary windings, and a ballast capacitor connected in series with the secondary winding and two serially connected fluorescent lamps of low starting and operating voltage, the secondary circuit being connected to a tap on the primary winding for reducing the ratio of the ballast power input to the lamp light output. A starting capacitor connected across one of the lamps has a resistor of predetermined resistance connected in shunt therewith to reduce the peak voltage to ground resulting from removal of that lamp from the circuit, so that electrical shock hazard to service personnel is minimized.

4 Claims, 2 Drawing Figures

HIGH EFFICIENCY BALLAST SYSTEM FOR GASEOUS DISCHARGE LAMPS

The present invention relates to electrical ballast systems for starting and operating gaseous discharge lamps, and more particularly concerns high efficiency ballast apparatus for operating fluorescent lamps.

The present invention provides an improvement in the ballast system disclosed in copending application Ser. No. 891,889, Riesland et al, filed Mar. 30, 1978 and assigned to the same assignee as the present invention.

It is an object of the invention to provide a lamp-ballast system of the above type having improved safety characteristics.

A particular object of the invention is to provide a ballast system of the above type having a starting capacitor across one of a plurality of lamps wherein the risk of electrical shock upon removal of the lamp is markedly reduced.

Other objects and advantages will become apparent from the following description and the appended claims.

With the above objects in view, the present invention in one of its aspects relates to a ballast apparatus for starting and operating low pressure gaseous discharge lamps comprising, in combination, input terminal means for connection to an alternating current supply, high leakage reactance autotransformer means having primary winding means and secondary winding means, the primary winding means being connected at opposite ends to the input terminal means, secondary circuit means including the secondary winding means and means for serially connecting a pair of low pressure gaseous discharge lamps to the secondary winding means and the primary winding means, starting capacitor means connected to the secondary circuit means for staring the serially connected gaseous discharge lamps, and resistor means connected across the staring capacitor means for reducing the peak voltage to ground of the lamp connecting means.

Figure 1:
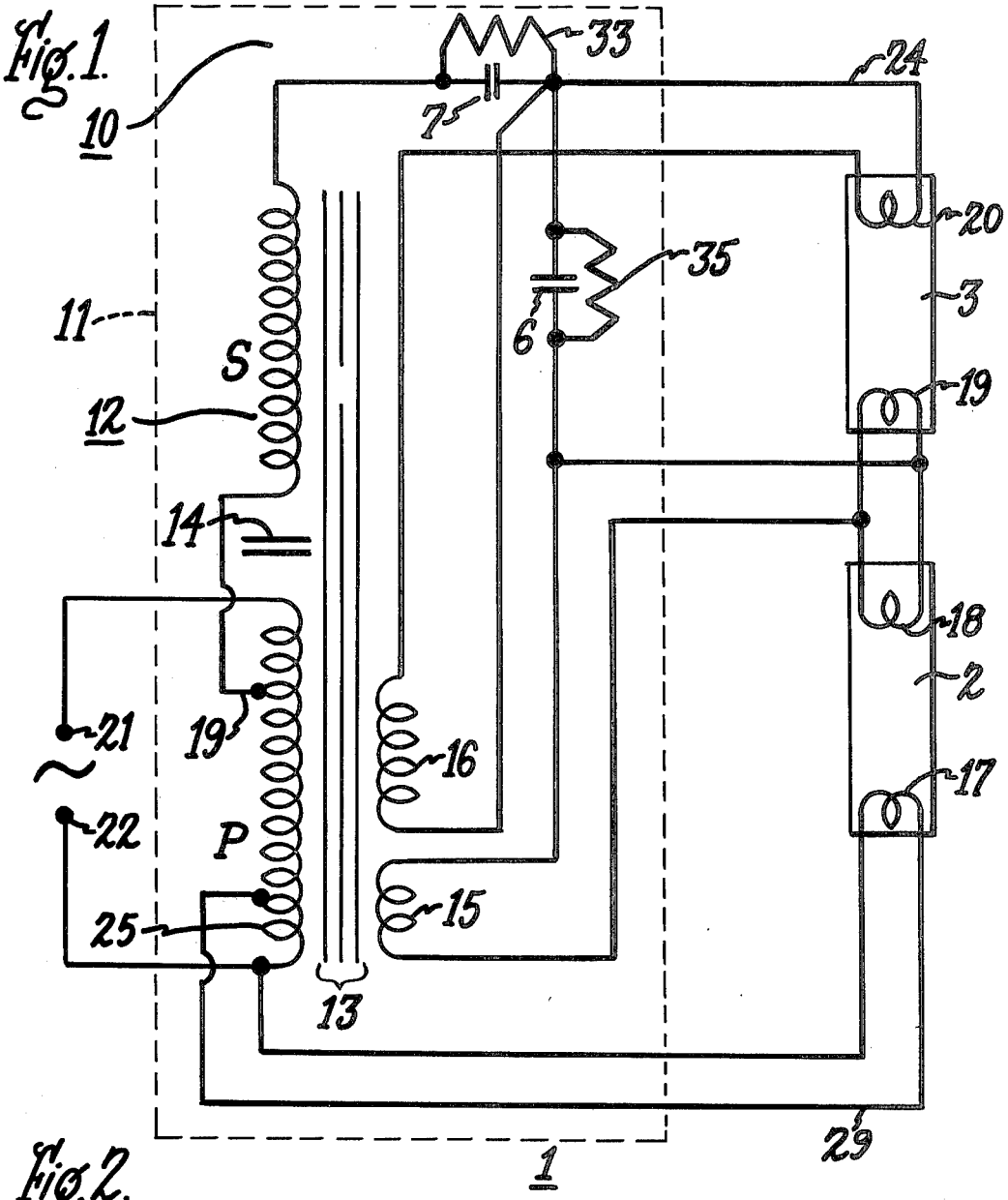
Figure 2:
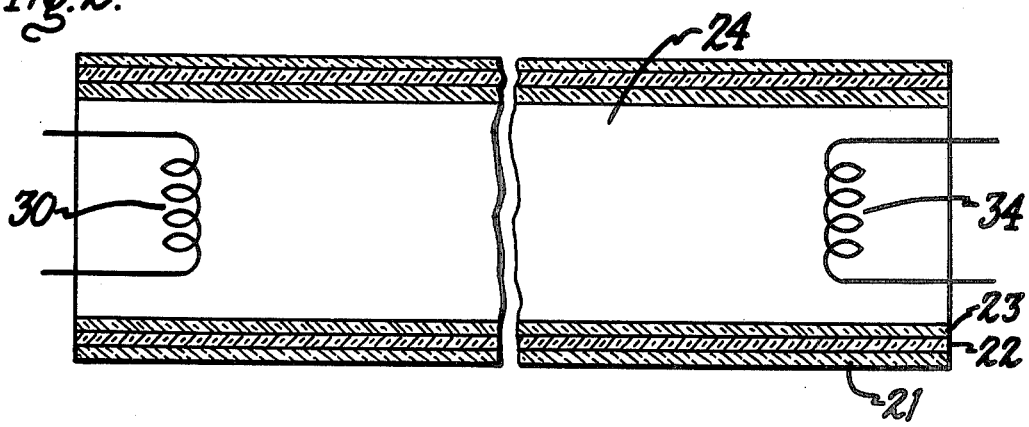

The invention will be better understood from the following description taken in conjunction with the accompanying drawing, in which:

FIG. 1 is a circuit diagram of a lamp ballast system showing an embodiment of the invention; and FIG. 2 is a diagrammatic sectional view of a fluorescent lamp which may be employed in the lamp-ballast system of the invention.

Referring now to the drawings, and particularly to FIG. 1, there is shown a lamp ballast circuit 1 embodying the invention for starting and operating a pair of serially connected fluorescent lamps 2 and 3.

Such lamps may be of the known low energy type shown in FIG. 2, which in the illustrated form comprises a glass envelope 21 having electrodes 30, 34 at its opposite ends, a thin, transparent coating of activated tin oxide 22 serving as an internal starting aid, and a fluorescent phosphor coating 23. Contained within envelope 21 is a filling gas comprising mercury and a mixture of krypton and neon in a volume ratio of about 80% to 20% at a pressure of about 1.5 torr. Other inert gases such as argon may replace the neon gas. By "low energy lamp type" is meant lamps which operate at lower wattage than those of equivalent size without proportional loss of lamp efficiency.

Ballast apparatus 10 as illustrated in FIG. 1 is shown enclosed in a dashed rectangle 11 which schematically represents a ballast case. Ballast apparatus 10 includes a high leakage reactance autotransformer 12 having a magnetic core 13, magnetic shunts 14, a primary winding P and a secondary winding S inductively coupled therewith. A plurality of cathode heating windings 15, 16, and 25, are inductively coupled with primary winding P to supply heating current to the lamp filaments 17, 18 and 19, 20 of lamps 2 and 3 respectively. A pair of input terminals 21, 22 are provided for connection to a suitable alternating current supply (not shown) such as a 60 cycle, 120 volt AC supply.

In the illustrated embodiment, a flux leakage path is provided between primary winding P and secondary winding S by virtue of shunts 14 arranged between the windings.

Series capacitor 7 connected at one side to secondary winding S and at the other side to lamp 3 provides leading current in the secondary (lamp) circuit, and in combination with autotransformer 12 provides a current limiting ballast function for the lamp load, as well understood in the art. Resistor 33 across capacitor 7 serves to remove the charge on the capacitor when the circuit is de-energized.

Secondary winding S is connected with one terminal of lamp 3 by circuit means which include capacitor 7 and conductor lead 24, while the other end of serially connected lamp 2 is connected by conductor lead 29 to the end of primary winding P which is connected to input terminal 22.

A starting capacitor 6 is connected across lamp 3 so that open circuit starting voltage is initially applied across lamp 2.

As disclosed in the aforementioned Riesland et al application, the disclosure of which is incorporated herein by reference, one end of secondary winding S is connected to a tap 19 on primary winding P so as to reduce the voltage in the lamp circuit. It was found that this arrangement results in such advantages as improving the operating efficiency of the ballast circuit, lowering the series capcacitor voltage, and reducing the crest factor of the lamp current waveform, i.e., the ratio of the peak lamp current to the RMS value of lamp current.

Other details of the ballast system contruction and operation are disclosed in the Riesland et al application. As disclosed in the latter application, starting capacitor 6 in the FIG. 1 circuit is preferably of higher value than previously used with low energy lamps of the type shown in FIG. 2 in order to facilitate starting of the lamps. In a circuit of the described type, it was found by Riesland et al that use of a starting capacitor having a value in the range of about 0.08–0.16 microfarads produced unexpectedly large improvement in the starting of lamps of the described type.

With the use of such higher value capacitors, the peak voltage to ground at the sockets of lamp 3 when the latter is removed from the circuit for any reason may be as much as 350 volts or higher, and may thus present a safety hazard to a person servicing the fixture who inadvertently comes into contact with the exposed lamp socket. Such high voltage apparently results from the resonant condition involving the serially connected secondary winding S, starting capacitor 6 and remaining lamp 2. In accordance with the present invention, a resistor 35 having a resistance in the range of about 50 K ohms to about 500 K ohms, preferably in th range of about 80–120 K ohms, is connected across starting capacitor 6, resulting in a reduction of the above-mentioned peak voltage to an acceptable level, i.e., less than 325 volts.

It has been found that where resistor 35 is less than about 50 K ohms, excessive current passes through it during operation of lamps, thus wasting the input power. On the other hand, when resistor 35 is higher than about 500 K ohms it does not effectively dampen the above-described resonant condition and the peak voltage to ground with lamp 3 removed is above a safe level.

In a ballast system of the rapid start type such as shown in FIG. 1 which has produced satisfactory results in accordance with the invention, the components had the following values:

| | | |
|---|---|---|
| Primary winding P | - | 853 turns |
| Secondary winding S | - | 1,422 turns |
| Turns tapped off primary | - | 204 turns |
| Transformer core | - | Shell type |
| Center leg, cross section | - | .57 $in^2$. |
| Cathode heating winding 25 | - | 28 turns |
| Cathode heating winding 15 | - | 33 turns |
| Cathode heating winding 16 | - | 31 turns |
| Series capacitor 7 | - | 4.5 mfd |
| Starting capacitor 6 | - | .1 mfd |
| Resistor 35 | - | 100 K ohms |
| Lamps, two | - | 48 in., 35 watt, Rapid Start |

It was found that in a ballast system of the above construction the peak voltage to ground at the socket of the removed lamp was about 310 volts, compared to a voltage of at least 350 volts when using a resistor 35 having a value outside the above-specified range of resistance. It was found further that the peak voltage to ground in the above ballast construction could be reduced substantially below 300 volts when the resistor had a value of 70–80 K ohms and where the starting capacitor was 0.1 microfarad. In general, in accordance with the invention, the higher the value of starting capacitor 6, the lower the resistance of resistor 35, and vice versa.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. Ballast apparatus for starting and operating low pressure gaseous discharge lamps comprising, in combination, input terminal means for connection to an alternating current supply to provide input power to the ballast apparatus, high leakage reactance auto-transformer means having primary winding means and secondary winding means, said primary winding means being connected at opposite ends to said input terminal means, secondary circuit means including said secondary winding means and means for serially connecting a pair of low pressure gaseous discharge lamps to said secondary winding means and said primary winding means, starting capacitor means connected to said secondary circuit means for starting the serially connected gaseous discharge lamps, and resistor means connected across said starting capacitor means for reducing the peak voltage to ground of said lamp connecting means, said starting capacitor means having a capacitance of about 0.08 to 0.16 microfarads, said resistor means having a resistance of about 50 K ohms to 500 K ohms.

2. Ballast apparatus as defined in claim 1, wherein said resistor means has a resistance of about 80 K ohms to 120 K ohms.

3. Ballast apparatus for starting and operating low pressure gaseous discharge lamps comprising, in combination, input terminal means for connection to an alternating current supply to provide input power to the ballast apparatus, high leakage reactance autotransformer means having primary winding means and secondary winding means, said primary winding means being connected at opposite ends to said input terminal means, secondary circuit means including said secondary winding means and means for serially connecting a pair of low pressure gaseous discharge lamps to said secondary winding means and said primary winding means, starting capacitor means connected to said secondary circuit means for starting the serially connected gaseous discharge lamps, and resistor means connected across said starting capacitor means for reducing the peak voltage to ground of said lamp connecting means, said secondary circuit means connected to a tap on said primary winding means for supplying from said primary winding means a predetermined voltage in said secondary circuit means for reducing the ratio of said power input to the lamp light output, said starting capacitor means having a capacitance of about 0.08 to 0.16 microfarads, said resistor means having a resistance of about 50 K ohms to 500 K ohms.

4. Ballast apparatus as defined in claim 3, and a pair of serially connected low energy fluorescent lamps connected to said lamp connecting means, said starting capacitor means connected across one of said lamps, said resistor means operating to reduce the peak voltage to ground of said lamp connecting means upon removal of said one lamp therefrom.

* * * * *